US007802902B2

(12) United States Patent
Moss et al.

(10) Patent No.: US 7,802,902 B2
(45) Date of Patent: Sep. 28, 2010

(54) LED LIGHTING FIXTURES

(75) Inventors: Timothy B. Moss, Chicago, IL (US); Eric J. Kille, Mundelein, IL (US); Mubasher Ahmad, Chicago, IL (US); James M. Gaines, Glen Ellyn, IL (US); Bernd Clauberg, Schaumburg, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 272 days.

(21) Appl. No.: 12/088,360

(22) PCT Filed: Sep. 25, 2006

(86) PCT No.: PCT/IB2006/053482

§ 371 (c)(1),
(2), (4) Date: Mar. 27, 2008

(87) PCT Pub. No.: WO2007/036871

PCT Pub. Date: Apr. 5, 2007

(65) Prior Publication Data

US 2008/0273331 A1 Nov. 6, 2008

Related U.S. Application Data

(60) Provisional application No. 60/721,018, filed on Sep. 27, 2005.

(51) Int. Cl.
*F21V 33/00* (2006.01)

(52) U.S. Cl. ..... 362/249.02; 362/800; 362/612

(58) Field of Classification Search ..... 362/612, 362/800, 249.02
See application file for complete search history.

(56) References Cited

U.S. PATENT DOCUMENTS

| | | | | |
|---|---|---|---|---|
| 6,871,983 | B2 | 3/2005 | Jacob et al. | |
| 2002/0122309 | A1 | 9/2002 | Abdelhafez et al. | |
| 2002/0130786 | A1 | 9/2002 | Weindorf | |
| 2002/0135572 | A1 | 9/2002 | Weindorf | |
| 2002/0179816 | A1 | 12/2002 | Haines et al. | |
| 2004/0041702 | A1 | 3/2004 | Toulmin et al. | |
| 2004/0090785 | A1 | 5/2004 | McInnis | |
| 2004/0095777 | A1 | 5/2004 | Trenchard et al. | |
| 2005/0024870 | A1 | 2/2005 | Coushaine | |
| 2005/0024893 | A1 * | 2/2005 | Wainwright | 362/567 |
| 2005/0122713 | A1 | 6/2005 | Hutchins | |
| 2005/0254013 | A1 * | 11/2005 | Engle et al. | 353/52 |
| 2005/0279949 | A1 * | 12/2005 | Oldham et al. | 250/458.1 |
| 2007/0090962 | A1 * | 4/2007 | Price et al. | 340/691.1 |
| 2007/0127031 | A1 * | 6/2007 | Kang et al. | 356/454 |

FOREIGN PATENT DOCUMENTS

| | | | |
|---|---|---|---|
| GB | 2408315 | A | 5/2005 |
| WO | 2005006818 | A1 | 1/2005 |
| WO | 2006056066 | A1 | 6/2006 |

* cited by examiner

*Primary Examiner*—Laura Tso

(57) ABSTRACT

A lighting fixture (20-23) mechanically encloses a LED module (30), which includes at least one LED (40) and can further include a LED driver (50) in electrical communication with the LED(s) (40) to operably provide a LED drive signal to the at least one LED (40), a thermal management system (60) in thermal communication with the LED(s) (40) and the lighting fixture (20-23) to facilitate a heat transfer from the LED(s) (40) to the lighting fixture (20-23), and/or a beam shaper (70) in optical communication with the LED(s) (40) to modify an illumination profile of a radiation beam emitted by the LED(s) (40).

19 Claims, 12 Drawing Sheets

LED LIGHTING FIXTURES

CROSS REFERENCE TO RELATED APPLICATION

This application claims the benefit of U.S. provisional application Ser. No. 60/721,018, filed Sep. 27, 2005, the entire subject matter of which is hereby incorporated by reference.

The present invention generally relates to lighting fixtures of any type. The present invention specifically relates to mechanically enclosing light emitting diode ("LED") modules within lighting fixtures.

FIGS. 1-4 illustrate general views of known lighting fixtures 20-23. Typically, incandescent lamps are used in lighting fixtures 20-23 with a power generally in a range of twenty (20) watts to fifty (50) watts. The present invention is based on a discovery that mechanically enclosing LED modules within lighting fixtures 20-23 can provide numerous benefits over the present day use of incandescent lamps in lighting fixtures 20-23. For example, a general lifetime for a LED module of 50,000 hours is significantly greater than a maximum lifetime achievable by an incandescent lamp. Further, LED modules can be designed to use between five (5) watts and fifteen (15) watts of power, which is considerably less than the power range of incandescent lamps. Additionally, a lower operation temperature is achievable with LED modules.

Based on this discovery, the present invention is a lighting apparatus comprising a LED module mechanically enclosed within a lighting fixture (e.g., lighting fixtures 20-23 shown in FIGS. 1-4).

In a first form of the present invention, the LED module includes one or more LEDs and a LED driver (a.k.a., a LED ballast) in electrical communication with the LED(s) to operably provide a LED drive signal to the LED(s). The LED module further includes a thermal sensor operable to facilitate a control by the LED driver of a magnitude of the LED drive signal based on an operating temperature of the LED(s) as sensed by the thermal sensor.

In a second form of the present invention, the LED module includes one or more LEDs mounted on a thermal management system in thermal communication with the lighting fixture to facilitate heat transfer from the LED(s) to the lighting fixture.

In a third form of the present invention, the LED module includes an LED emitting a radiation beam having an illumination profile and a beam shaper in optical communication with the LED to modify the illumination profile of the emitted radiation beam. The beam shaper includes one or more optical components optically aligned with the LED(s) to thereby modify the illumination profile of the radiation beam emitted by the LED(s). The beam shaper further includes one or more heat shrink tubes fitted around the optical component(s) to securely maintain the optical alignment of the optical component(s) with the LED(s).

The foregoing forms and other forms of the present invention as well as various features and advantages of the present invention will become further apparent from the following detailed description of various embodiments of the present invention read in conjunction with the accompanying drawings. The detailed description and drawings are merely illustrative of the present invention rather than limiting, the scope of the present invention being defined by the appended claims and equivalents thereof.

Figure 5:
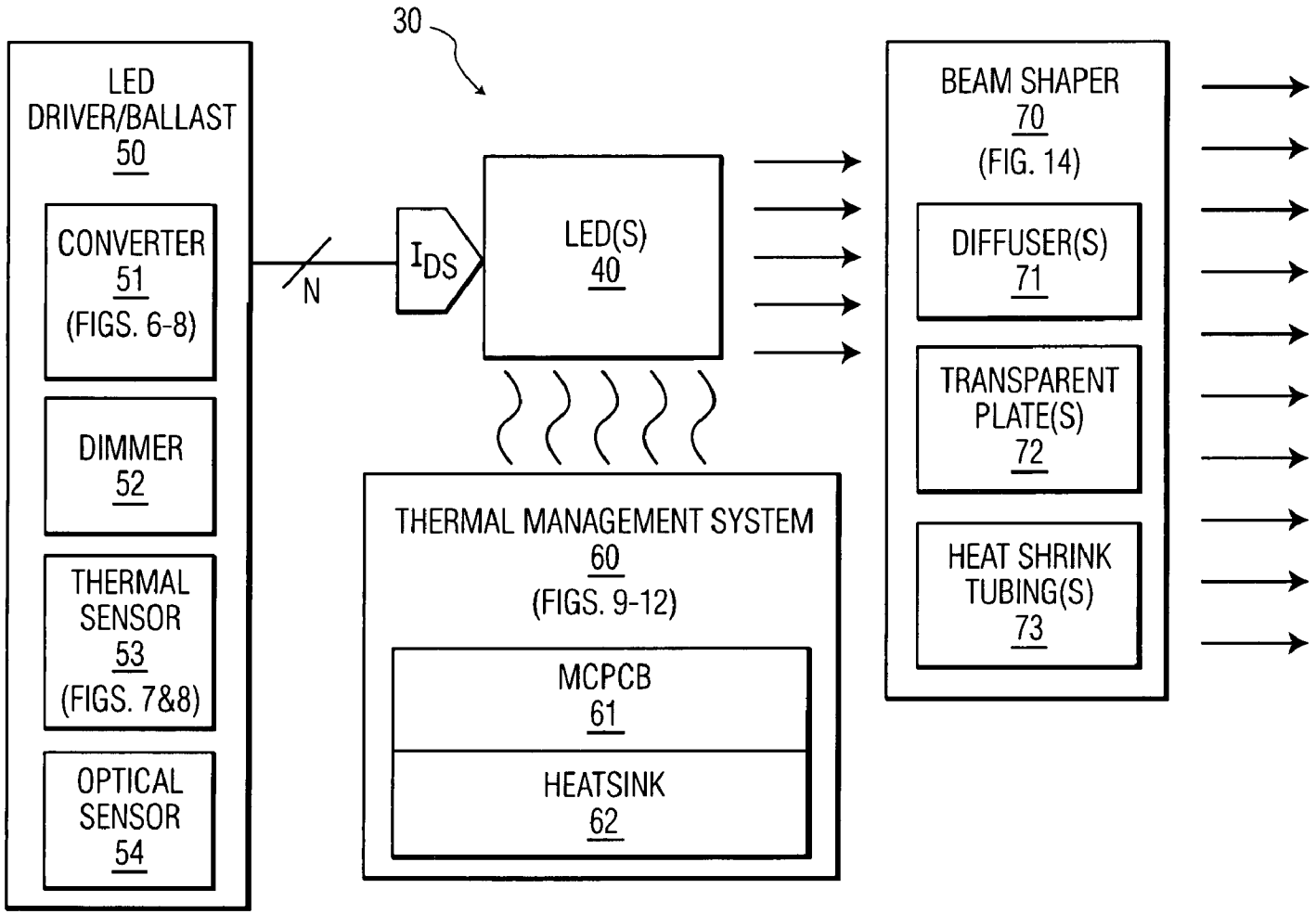
FIG. 5 illustrates a block diagram of one embodiment of a LED module in accordance with the present invention.

A LED module 30 as shown in FIG. 5 employs LED(s) 40, a LED driver/ballast 50, a thermal management system 60 and a beam shaper 70. LED(s) 40 (e.g., Luxeon LEDs) can be embodied as a single LED of any color, or as a series coupling of LEDs of any color combination, a parallel coupling of LEDs of any color combination or any coupling combination thereof.

LED driver/ballast 50 is structurally configured to electrically communicate a N number of LED drive signals $I_{DS}$ to LED(s) 40 in dependence upon the structural configuration of LED(s) 40 as would be appreciated by those having ordinary skill in the art. In practice, each structural configuration of a LED driver/ballast 50 of the present invention is dependent upon its commercial implementation. Thus, the present invention does not impose any limitations or any restrictions to each structural configuration of LED driver/ballast 50 of the present invention. In one embodiment, LED driver/ballast 50 includes a converter 51 as shown in FIG. 5 for converting an incoming AC signal into the N number of LED drive signals $I_{DS}$. To control an illumination intensity of LED(s) 40, LED driver/ballast can further include a dimmer 52, a thermal sensor 53 and/or an optical sensor 54 as shown in FIG. 5.

Dimmer 52 facilitates a control by converter 51 of a magnitude of the LED drive signal(s) $I_{DS}$ based on dimming control signal(s) as would be appreciated by those having ordinary skill in the art. Thermal sensor 53 facilitates a control by converter 51 of a magnitude of the LED drive signal(s) $I_{DS}$ based on an operating temperature of LED(s) 40 as sensed by thermal sensor 53.

Optical sensor 54 facilitates a control by converter 51 of a magnitude of the LED drive signal(s) $I_{DS}$ based on an illumination level of an ambient light exterior to the lighting fixture as sensed by optical sensor 54 (e.g., controlling a powering ON and OFF of LEDs (40) based on whether the optical sensor 54 senses daytime light or nighttime light ambient to the exterior of the lighting fixture).

Figure 6:
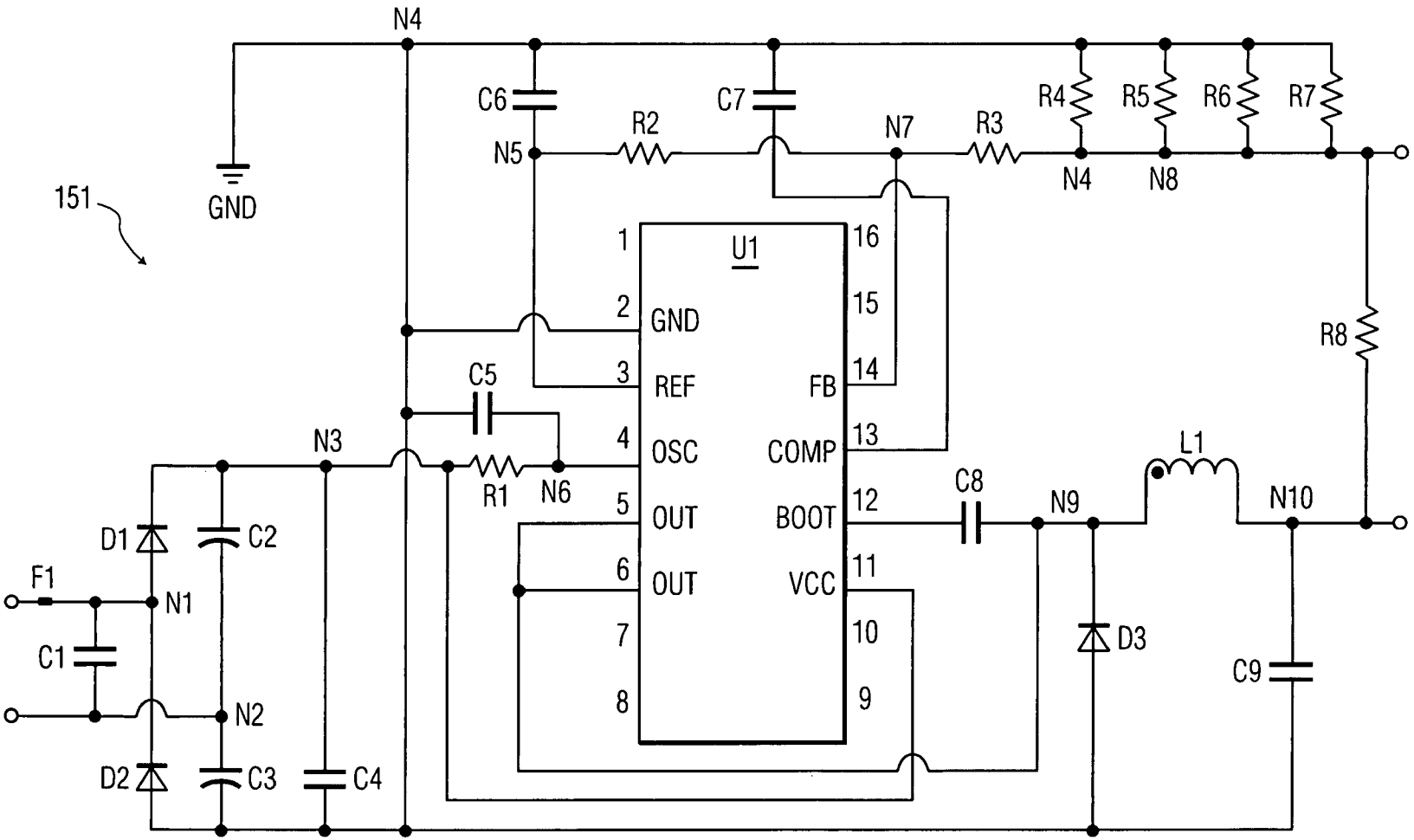
FIG. 6 illustrates a schematic diagram of a first embodiment of a LED driver in accordance with the present invention.

FIG. 6 illustrates an embodiment 151 of converter 51 (FIG. 5). Referring to FIG. 6, converter 51 is operated based on a buck converter U1 in the form of a L4976, 1A step down switching regulator having a voltage doubling input. Buck converter U1 has a pin 2 GND connected to a ground node N4, a pin 3 REF connected to a node N5, a pin 4 OSC connected to a node N6, a pair of pins 5 and 6 OUT connected to a node N9, a pin 11 VCC connected to a node N3, a pin 12 BOOT connected to a capacitor C8, a pin 13 COMP connected to a capacitor C7 and a pin 14 FB connected to a node N7.

Converter 151 further includes a fuse F1 connected to one input terminal and a node N1. A capacitor C1 (e.g., 1 μF) connected to node N1 and a node N2. A diode D1 (e.g., 60V 3A) connected to node N1 and node N3. A diode D2 (e.g., 60V 3A) connected to node N1 and node N4. A capacitor C2 (e.g., 1000 μF) connected to node N3 and node N2. A capacitor C3 (e.g., 1000 μF) connected to node N2 and node N4. A capacitor C4 (e.g., 100 ηF) connected to node N3 and node N4.

A capacitor C5 (e.g., 1 ηF) and a resistor R1 (e.g., 39 kΩ) connected in parallel to node N3 and node N6. A capacitor C6 (e.g., 100 ηF) connected to node N4 and node N5. Capacitor C7 (e.g., 47 ηF) further connected to node N4. A resistor R2 (e.g., 10.5 kΩ) connected to node N5 and node N7. A resistor R3 (e.g., 18 kΩ) connected to node N7 and a node N8. A resistor R4 (e.g., 2Ω), a resistor R5 (e.g., 2Ω), a resistor R6 (e.g., 2Ω) and a resistor R7 (e.g., 2Ω) connected in parallel to node N4 and node N8.

Capacitor C8 (e.g., 100 ηF) is further connected to node N9. A diode D3 (e.g., 60V 3A) connected to node N9 and node N4. An inductor L1 (e.g., 220 μH) connected to node N9 and a node N10. A capacitor C9 (e.g., 1 μF) connected to node N10 and node N4.

In one alternate embodiment, diode D3 is omitted and LED(s) 40 are connected to node N9 and N3 to thereby facilitate buck converter U1 operation as a step down switch regulator.

In another alternative embodiment, capacitors C2 and C3 are omitted and converter 151 is transformed into buck/boost configuration as would be appreciated by those having ordinary skill in the art.

Figure 7:
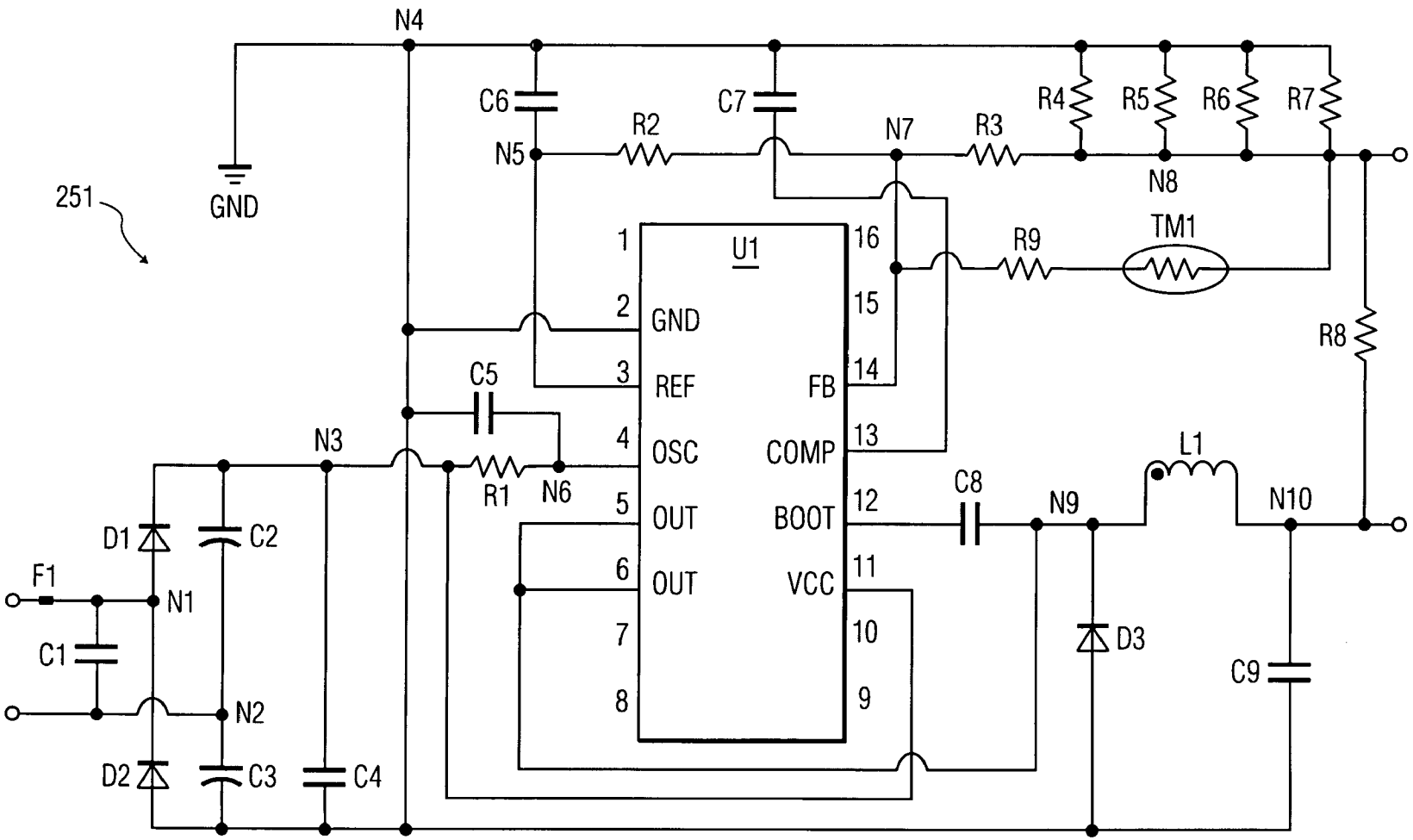
FIG. 7 illustrates a schematic diagram of a second embodiment of a LED driver in accordance with the present invention.

FIG. 7 illustrates an embodiment 251 of converter 151 (FIG. 6) additionally employing a resistor R9 (e.g. 14 kΩ) and a thermistor TM1 (e.g., PTC) connected in series to node N7 and node N8, changing the value of resistor R2 (e.g., 1200Ω) and resistor R3 (e.g. 2.43 kΩ). Thermistor TM1 is strategically located relative to LED(s) 40 to sense, directly or indirectly, an operating temperature of LED(s) 40 as will be further explained herein in connection with FIGS. 9-12. Further, thermistor TM1 provides feedback to buck converter U1 indicative of the operating temperature of LED(s) 40 as sensed by thermistor TM1.

Figure 8:
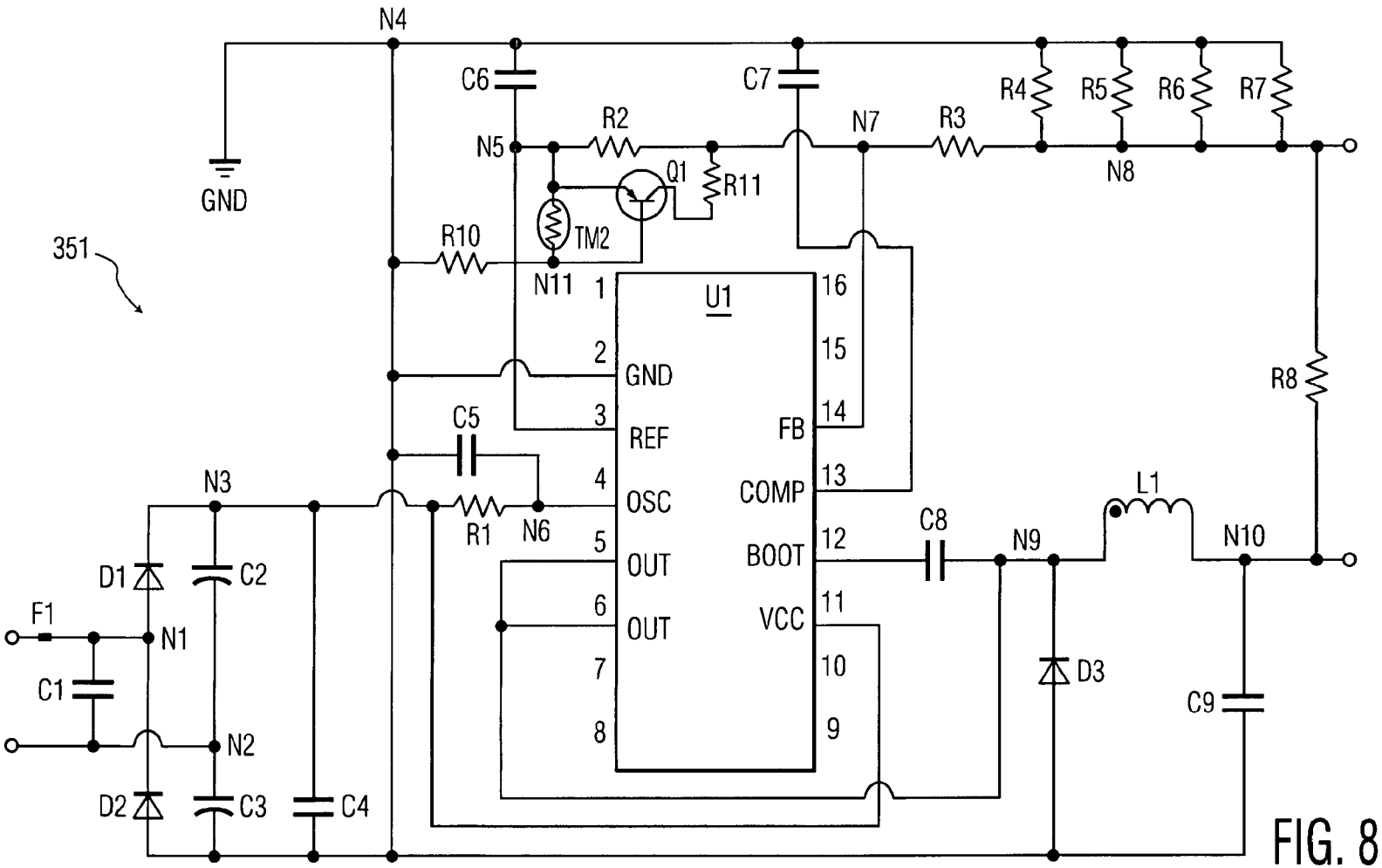
FIG. 8 illustrates a schematic diagram of a third embodiment of a LED driver in accordance with the present invention.

FIG. 8 illustrates an embodiment 351 of converter 151 (FIG. 6) additionally employing a resistor R10 connected to node N4 and a node N1. A thermistor TM2 is connected to node N5 and node N1. A PNP transistor Q1 having an emitter connected to node N5, a base connected to node N11, and a collector connected to a resistor R11, which is further connected to node N7. Thermistor TM2 is strategically located relative to LED(s) 40 to sense, directly or indirectly, an operating temperature of LED(s) 40 as will be further explained herein in connection with FIGS. 9-12. Further, thermistor TM2 provides feedback to buck converter U1 indicative of the operating temperature of LED(s) 40 as sensed by thermistor TM2 and transistor Q1 enhances this feedback as would be appreciated by those having ordinary skill in the art.

Referring again to FIG. 5, thermal management system 60 is structurally configured to serve as a mount for LED(s) 40 and LED driver/ballast 50 that transfers heat away from LED(s) 40 and LED driver/ballast 50 in a direction toward an interior of the lighting fixture. In practice, each structural configuration of a thermal management system 60 of the present invention is dependent upon its commercial implementation. Thus, the present invention does not impose any limitations or any restrictions to each structural configuration of a thermal management system 60 of the present invention. In one embodiment, thermal management system 60 employs a metal-core printed circuit board ("MCPCB") 61 integrated with a heat sink 62 as shown in FIG. 5. MCPCB 61 may have a vertical connector, forward or reverse or a horizontal connector in any direction for powering the LED(s) 40 and/or LED driver/ballast 50 mounted thereon.

Figure 9:
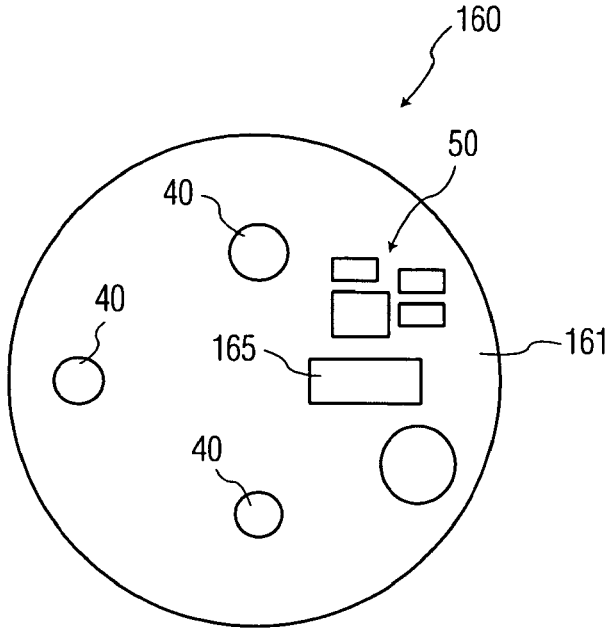
FIGS. 9 and 10 illustrate, respectively, a top view and a side view of a first embodiment of the thermal management system in accordance with the present invention.
Figure 10:
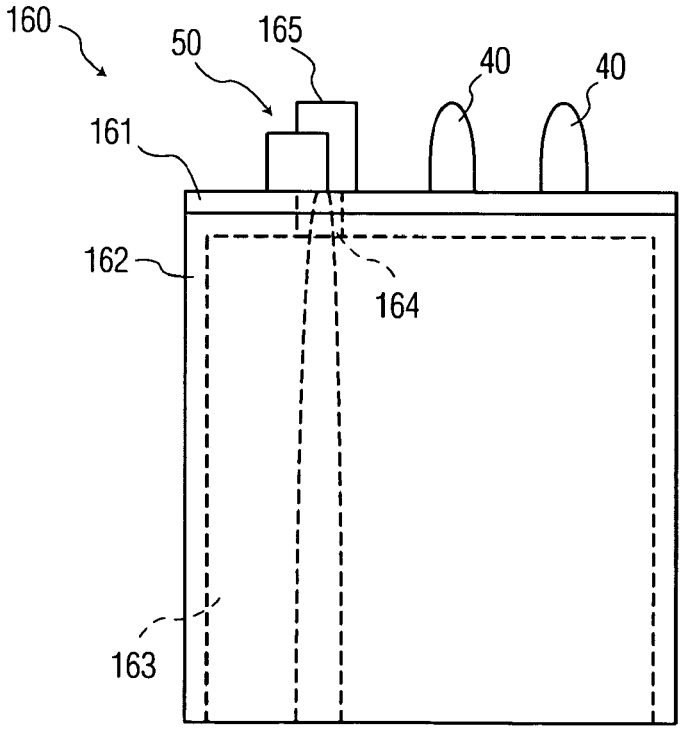

FIGS. 9 and 10 illustrate one embodiment 160 of thermal management system 60 (FIG. 5). Specifically, thermal management system 160 employs a MCPCB 161 having LED(s) 40, LED driver/ballast 50 and a reverse vertical connector 165 mounted on a top side thereof. If employed in LED driver/ballast 50, a thermal sensor in the form of thermistor TM1 (FIG. 7) or thermistor TM2 (FIG. 8) can be placed as close as possible to LED(s) 40 to directly sense the operating temperature of LED(s) 40 or anywhere else on MCPCB 161 to indirectly sense the operating temperature of LED(s) 40 as heat from LED(s) 40 is conducted by MCPCB 161 to the thermal sensor.

MCPCB 161 is aligned and integrated with a heat sink 162 having an inverted cup-shape with a cavity 163. A through-hole 164 bored through MCPCB 161 and heat sink 162 is below reverse vertical connector 165 facilitates a power connection to reverse vertical connector 165 from the bottom side of MCPCB 161 via heat sink 162. Reverse vertical connector 164 can be securely anchored to the top side of MCPCB 161 to reduce any stress on reverse vertical connector 164 when being connected to a power source (not shown). An asphalt potting or equivalent can be inserted within cavity 163 subsequent to the power connection of reverse vertical connector 164 to facilitate a reduction in the temperature of the LED module, spread the heat more equally in the LED module and to provide strain relief to the power wire connection.

In an alternate embodiment, a forward vertical connector or a horizontal connector can be substituted for reverse vertical connector 165. In such a case, the substituted connector will be offset from through-hole 164 to facilitate a running of the wires within through-hole 164 or in a gap between the lighting fixture and heat sink 162.

Figure 11:
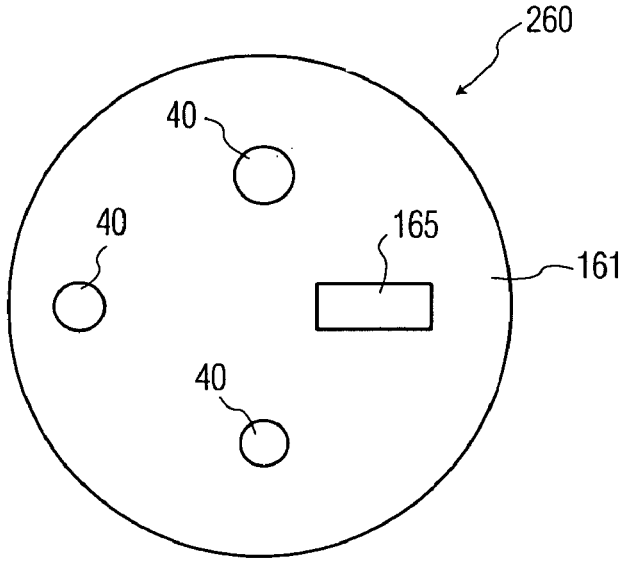
FIGS. 11 and 12 illustrate, respectively, a top view and a side view of a second embodiment of the thermal management system in accordance with the present invention.
Figure 12:
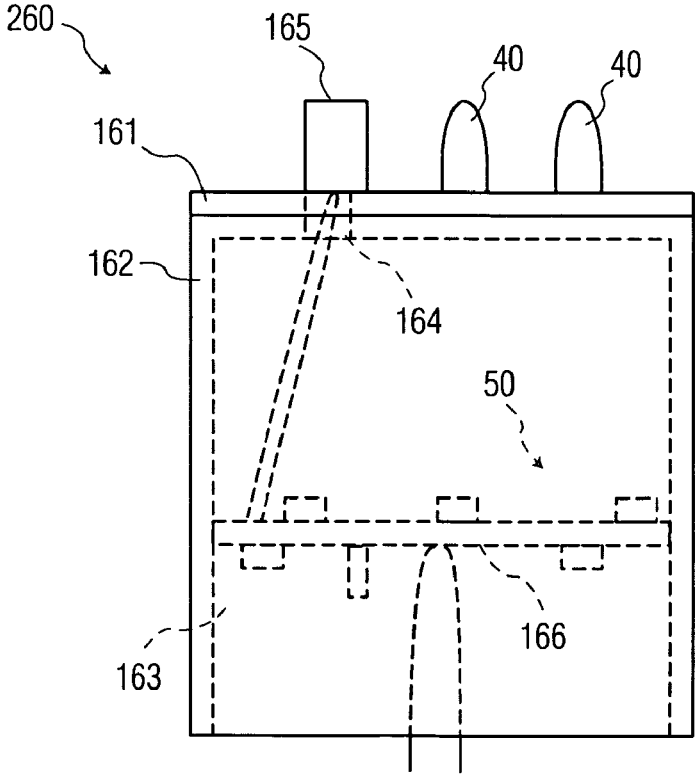

FIGS. 11 and 12 illustrate an embodiment 260 of thermal management system 60 (FIG. 5). Thermal management system 260 includes a FR4 printed circuit board ("PCB) 166 disposed within cavity 163 of heat sink 162 whereby a power connection is made to reverse vertical connector 165 from FR4 PCB 166. In this embodiment, an entirety of LED driver/ballast 50 can be mounted on FR4 PCB 166 as shown or LED driver/ballast 50 can be distributed between MCPCB 161 and FR4 PCB 166. For example, if employed in LED driver/ballast 50, a thermal sensor in the form of thermistor TM1 (FIG. 7) or thermistor TM2 (FIG. 8) can be mounted on MCPCB 161 and placed as close as possible to LED(s) 40 to thereby directly sense the operating temperature of LED(s) 40 or mounted on FR4 PCB 166 to indirectly sense the operating temperature of LED(s) 40 via the potting material in heat sink cavity 163.

Figure 1A:
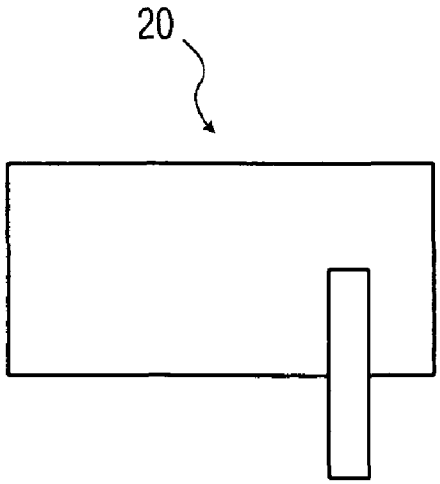
FIG. 1A PRIOR ART
FIGS. 1-4 illustrates various lighting fixtures as known in the art.
Figure 1B:
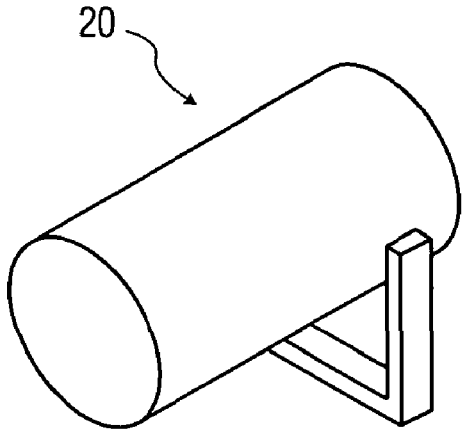
FIG. 1B PRIOR ART
Figure 2A:
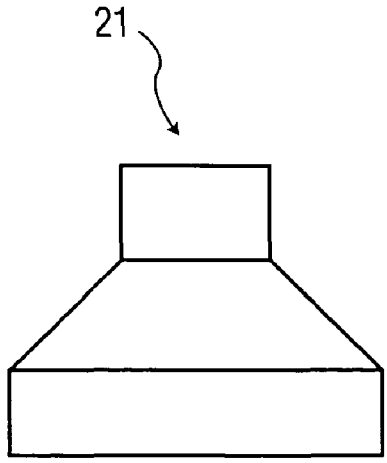
FIG. 2A PRIOR ART
Figure 2B:
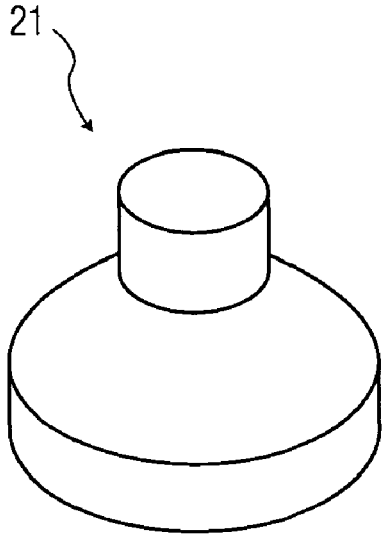
FIG. 2B PRIOR ART
Figure 3A:
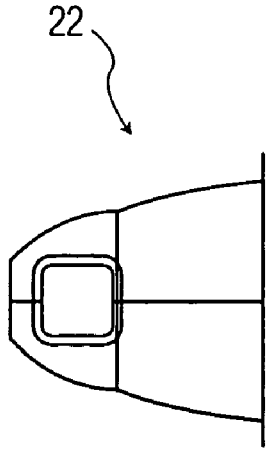
FIG. 3A PRIOR ART
Figure 3B:
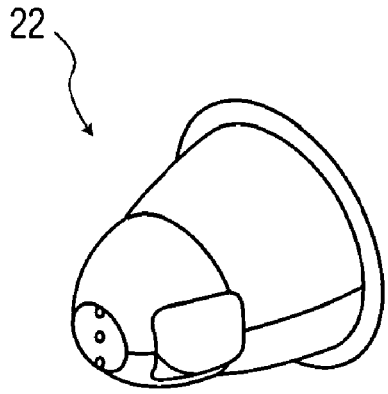
FIG. 3B PRIOR ART
Figure 4A:
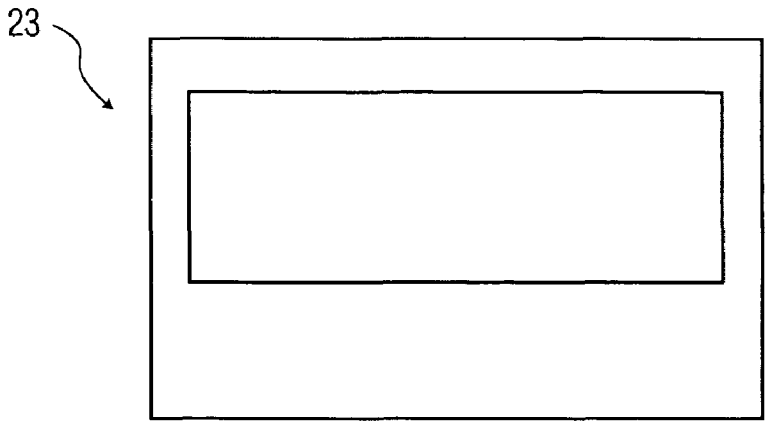
FIG. 4A PRIOR ART
Figure 4B:
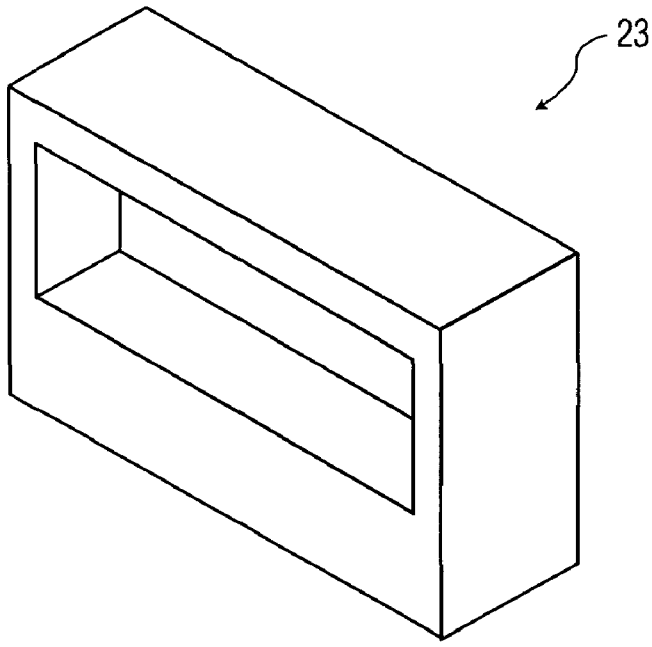
FIG. 4B PRIOR ART
Figure 13:
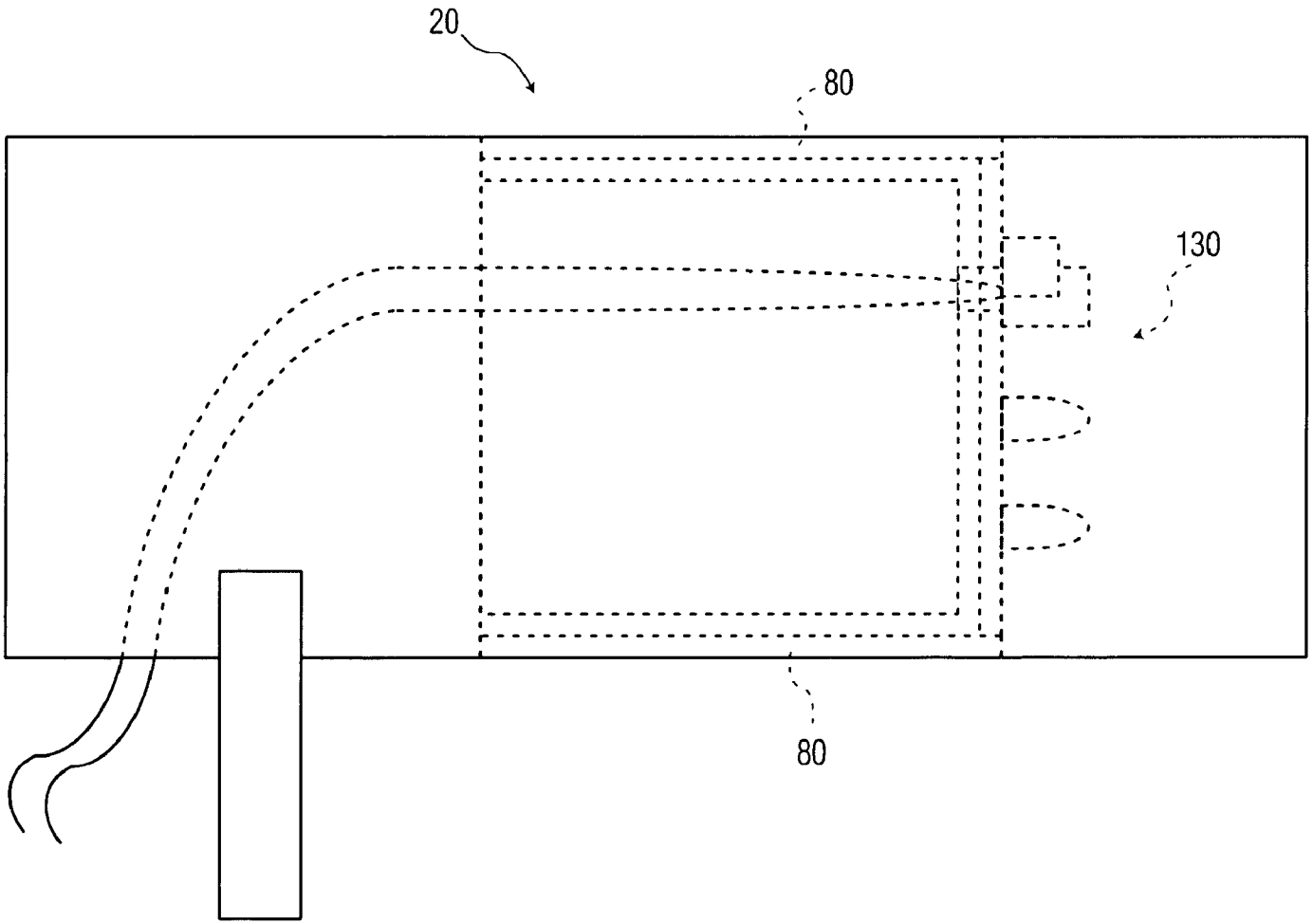
FIG. 13 illustrates an exemplary mechanical enclosure of the LED module illustrated in FIGS. 9 and 10 in the lighting fixture illustrated in FIG. 4.

FIG. 13 illustrates an exemplary mechanical enclosure of a LED module 130 with lighting fixture 20 (FIG. 1) based on the inventive principles of the present invention previously discussed herein. LED module 130 can be mounted within lighting fixture 20 by any means as would be appreciated by those having ordinary skill in the art. Additionally, an exterior of LED module 130, particularly the heat sink, should be as close as possible to an interior of lighting fixture 20 to facilitate a low thermal resistive path for heat transfer from LED module 130 to the exterior of lighting fixture 20. Additionally, to supplement the low thermal resistive path within the minimal gap between the exterior of LED module 130 and the interior of lighting fixture 20, a material 180 having a low thermal resistance than air (e.g., thermal grease, thermal pads, and potting material) can be inserted within the minimal gap as shown.

Referring again to FIG. 5, beam shaper 70 is structurally configured to modify the illumination profile of a radiation beam emitted from LED(s) 40, such as, for example, increase the size of the profile, decrease the size of the profile, and focus the profile in a particular direction or direction(s). This is particularly important for lighting fixtures having a physical structure that may produce shadows in the illumination profile of LED(s) 40, such as, for example, lighting fixture 20-23 shown in FIGS. 1-4, respectively.

In practice, each structural configuration of a beam shaper 70 of the present invention is dependent upon its commercial implementation. Thus, the present invention does not impose any limitations or any restrictions to each structural configuration of a beam shaper 70 of the present invention. In one embodiment, beam shaper 70 employs an optical diffuser 71 and/or a transparent plate 72 for each LED 40 or a grouping of LED(s) 40 where each optical diffuser 71/transparent plate 72 is a stand-alone optical component or is integrated with another optical component (e.g., a lens). Additionally, one or more pieces of heat shrink tubing 73 can be used as a basis for maintaining an optical alignment of optical diffuser 71 and/or transparent plate 72 to a LED 40 or a grouping of LED(s) 40. Heat shrink tubing 73 further provides protection against the environment by sealing all the gaps between the other components of beam shaper 70.

Figure 14:
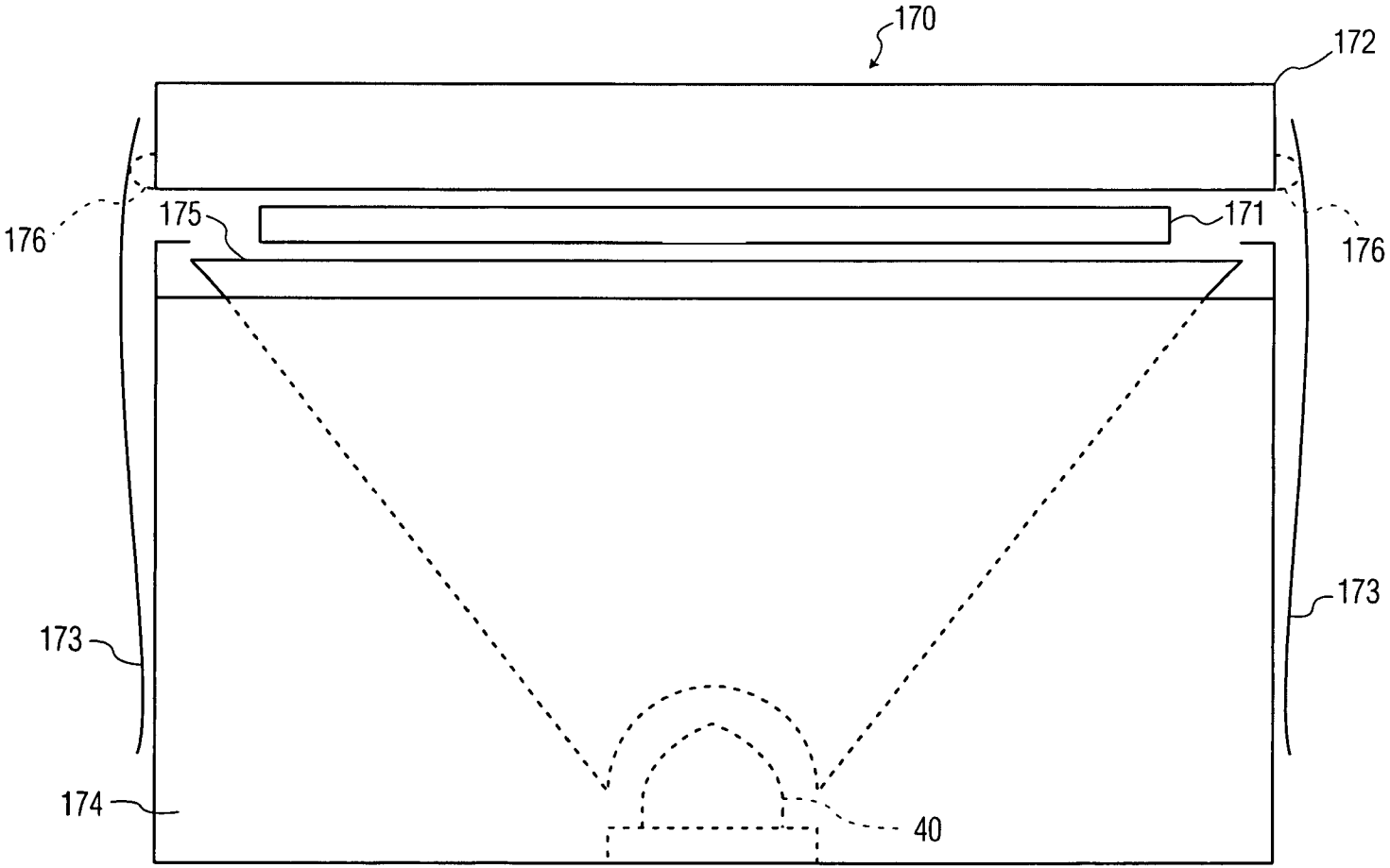
FIG. 14 illustrates a side view of one embodiment of an optical diffuser in accordance with the present invention.

FIG. 14 illustrates an embodiment 170 of beam shaper 70. Beam shaper 170 employs a lens collimator 175 optically aligned with a LED 40, both of which are mounted in a lens holder 174. An optical diffuser 171 is positioned above the upper opening of lens collimator 175, and a transparent plate 172 of the lighting fixture, glass and/or plastic, is positioned above diffuser 171. A piece of heat shrink tubing 173 is used to couple and align all of the illustrated components. Specifically, heat shrink tubing 173 is initially loosely fitted around the other optical components of beam shaper 170 as shown in FIG. 15 whereby an application of appropriate degree of heat as would be appreciated by those having ordinary skill in the art will cause heat shrink tubing 173 to shrink to thereby tightly fit around the other optical components of beam shaper 170 to maintain the optical alignment of the other optical components of beam shaper 170 to LED 40 as well as protect these components from the environment. To enhance the tight fit of heat shrink tubing 173 around the other optical components, plate 172 can include a cylindrical extension 176 as represented by a dotted outline.

Referring to FIGS. 5-14, the inventive principles of the present invention were shown and described in connection with fitting lighting fixtures 20-23 (FIGS. 1-4) with LED modules to facilitate an understanding of the various inventive principles of the present invention. From these illustrations and descriptions, those having ordinary skill in the art will appreciate how to apply the various inventive principles of the present invention to of lighting fixtures other than lighting fixtures 20-23

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. A lighting apparatus, comprising:

a lighting fixture; and a LED module mechanically enclosed by the lighting fixture, wherein the LED module includes:

at least one LED, a LED driver in electrical communication with the at least one LED to operably provide a LED drive signal to the at least one LED, and a thermal sensor operable to facilitate a control by the LED driver of a magnitude of the LED drive signal based on an operating temperature of the at least one LED as sensed by the thermal sensor.

2. The lighting apparatus of claim 1, wherein the LED module further includes:

a thermal management system in thermal communication with the at least one LED and the lighting fixture to facilitate a heat transfer from the at least one LED to the lighting fixture.

3. The lighting apparatus of claim 1, wherein the LED module further includes:

a beam shaper in optical communication with the at least one LED to modify an illumination profile of a radiation beam emitted by the at least one LED.

4. The lighting apparatus of claim 1, wherein the LED driver includes a converter operable to convert an AC input signal into the LED drive signal.

5. The lighting apparatus of claim 4, wherein LED driver further includes a dimmer in electrical communication with the converter to facilitate a control by converter of a magnitude of the LED drive signal based on a dimming control signal.

6. The lighting apparatus of claim 4, wherein the thermal sensor is in electrical communication with the converter to facilitate a control by the converter of the magnitude of the LED drive signal based on an operating temperature of the at least one LED as sensed by the thermal sensor.

7. The lighting apparatus of claim 4, wherein the LED module further includes an optical sensor in electrical communication with the converter to facilitate a control by the converter of the magnitude of the LED drive signal based on an illumination level of an ambient light exterior to the lighting fixture as sensed by the optical sensor.

8. The lighting apparatus of claim 4, wherein the converter includes a buck converter operating as a step down switch regulator.

9. The lighting apparatus of claim 8, wherein the thermal sensor includes a thermistor operable to provide feedback to the buck converter indicative of an operating temperature of the at least one LED.

10. The lighting apparatus of claim 9, wherein the thermal sensor includes a further includes a transistor operable to enhance the feedback indicative of an operating temperature of the at least one LED as provided to the buck converter by the thermistor.

11. The lighting apparatus of claim 8, wherein the at least one LED serves as a means for facilitating an operation of the buck converter as a step down switch regulator.

12. A lighting apparatus, comprising:

a lighting fixture; and a LED module mechanically enclosed by the lighting fixture, wherein the LED module includes at least one LED and a LED driver, the at least one LED mounted on a thermal management system in thermal communication with the lighting fixture to facilitate a heat transfer from the at least one LED to the lighting fixture, and wherein the thermal management system includes a first printed circuit board having the at least one LED mounted thereon and a second printed circuit board having at least a portion of the LED driver mounted thereon.

13. The lighting apparatus of claim 12, wherein the LED module further includes a beam shaper in optical communication with the at least one LED to modify an illumination profile of a radiation beam emitted by the at least one LED.

14. The lighting apparatus of claim 12, wherein the first printed circuit board comprises a metallic printed circuit board, and wherein the thermal management system further includes a heat sink in thermal communication with the first printed circuit board and the lighting fixture to thereby facilitate the heat transfer from the at least one LED to the lighting fixture.

15. The lighting apparatus of claim 14, wherein the thermal management system further includes a through-hole bored through the first printed circuit board and the heat sink, the through hole being aligned with the cavity of the heat sink to facilitate a power wiring connection to the first printed circuit board.

16. The lighting apparatus of claim 14, wherein the heat sink is in electrical communication with the at least one LED to operably provide a LED drive signal to the at least one LED; and wherein the heat sink includes a cavity enclosing the second printed circuit board, and wherein the second printed circuit board comprises a non-metallic printed circuit board.

17. The lighting apparatus of claim 16, wherein the thermal management system further includes a through-hole bored through the first printed circuit board and the heat sink, the through hole being aligned with the cavity of the heat sink to facilitate a wiring of the first circuit board to the second printed circuit board.

18. A lighting apparatus, comprising:

a lighting fixture; and a LED module mechanically enclosed by the lighting fixture, wherein the LED module includes:

at least one LED, and a beam shaper in optical communication with the at least one LED to modify an illumination profile of a radiation beam emitted by the at least one LED, wherein the beam shaper includes:

at least one optical component optically aligned with the at least one LED to thereby modify the illumination profile of the radiation beam emitted by the at least one LED, and at least one heat shrink tubing fitted around the at least one optical component to securely maintain the optical alignment of the at least one optical component with the at least one LED, wherein the at least one optical component includes a transparent plate having an extension for enhancing a secure fit of the at least one heat shrink tubing around the at least one optical component.

19. The lighting apparatus of claim 18, wherein the at least one optical component includes at least one of an optical diffuser and a transparent plate.

* * * * *